US007302935B2

(12) United States Patent
Achleitner et al.

(10) Patent No.: US 7,302,935 B2
(45) Date of Patent: Dec. 4, 2007

(54) METHOD FOR OPERATING AN INTERNAL COMBUSTION ENGINE, FUEL SYSTEM, AND VOLUME FLOW CONTROL VALVE

(75) Inventors: Erwin Achleitner, Obertraubling (DE); Gerhard Eser, Hemau (DE)

(73) Assignee: Siemens Aktiengesellschaft, Munich (DE)

( * ) Notice: Subject to any disclaimer, the term of this patent is extended or adjusted under 35 U.S.C. 154(b) by 78 days.

(21) Appl. No.: 10/557,526

(22) PCT Filed: Apr. 22, 2004

(86) PCT No.: PCT/EP2004/050586

§ 371 (c)(1),
(2), (4) Date: Nov. 21, 2005

(87) PCT Pub. No.: WO2004/104397

PCT Pub. Date: Dec. 2, 2004

(65) Prior Publication Data

US 2006/0288984 A1 Dec. 28, 2006

(30) Foreign Application Priority Data

May 26, 2003 (DE) ..... 103 23 874

(51) Int. Cl.
*F02M 63/00* (2006.01)

(52) U.S. Cl. ..... 123/446; 123/447

(58) Field of Classification Search ..... 123/456, 123/457, 458, 510, 511, 514
See application file for complete search history.

(56) References Cited

U.S. PATENT DOCUMENTS 4,719,889 A * 1/1988 Amann et al. ..... 123/447
4,884,545 A 12/1989 Mathis
5,971,718 A * 10/1999 Krueger et al. ..... 417/286
6,058,912 A 5/2000 Rembold et al.
6,234,148 B1 * 5/2001 Hartke et al. ..... 123/447
6,253,734 B1 * 7/2001 Rembold et al. ..... 123/446
6,647,965 B1 * 11/2003 Breeden ..... 123/446
6,823,845 B2 * 11/2004 Schueler ..... 123/446

FOREIGN PATENT DOCUMENTS

| | | |
|---|---|---|
| CH | 674243 | 5/1990 |
| DE | 195 39 883 A1 | 11/1996 |
| DE | 196 12 413 A1 | 10/1997 |
| DE | 197 14 489 C1 | 10/1998 |
| EP | 0 643 219 A1 | 3/1995 |
| EP | 0 974 008 B1 | 1/2000 |
| EP | 1 273 780 A2 | 1/2003 |
| WO | WO 98/45594 | 10/1998 |
| WO | WO 03/023221 A1 | 3/2003 |

* cited by examiner

*Primary Examiner*—Thomas Moulis

(57) ABSTRACT

The invention relates to a method for operating an internal combustion engine comprising a fuel pressure accumulator, in order to provide fuel at a nominal pressure, pressure in a fuel pressure accumulator being generated by means of a high-pressure pump. According to said method, the high-pressure pump is supplied with a fuel flow via a volume flow control valve. In a first operating mode, the pressure in the fuel pressure accumulator is set to the nominal pressure, by regulating the fuel flow of the fuel delivered to the high-pressure pump by means of the volume flow regulating valve. In a second operating mode, the pressure in the fuel pressure accumulator is set to the nominal pressure, i.e. more specifically, the pressure in the fuel pressure accumulator is reduced to the nominal pressure.

13 Claims, 3 Drawing Sheets

METHOD FOR OPERATING AN INTERNAL COMBUSTION ENGINE, FUEL SYSTEM, AND VOLUME FLOW CONTROL VALVE

CROSS REFERENCE TO RELATED APPLICATION

This application is the U.S. National Stage of International Application No. PCT/EP2004/050586, filed Apr. 22, 2004 and claims the benefit thereof. The International Application claims the benefits of German Patent application No. 10323874.3 DE filed May 26, 2003, all of the applications are incorporated by reference herein in their entirety.

FIELD OF THE INVENTION

The invention relates to a method for operating an internal combustion engine which has a fuel pressure accumulator. The invention further relates to a fuel system for an internal combustion engine which has a fuel pressure accumulator, and to a volume flow control valve for use in a fuel system.

BACKGROUND OF THE INVENTION

In internal combustion engines, fuel is transported by means of a fuel pump from a tank in preparation for a subsequent high-pressure pump. The high-pressure pump is normally driven by the internal combustion engine and transports the fuel into a fuel pressure accumulator (fuel rail). The high-pressure pump itself is not regulated and conveys the fuel which is made available at its inlet connection into the fuel pressure accumulator.

In order to provide a defined fuel quantity to the high-pressure pump, provision is made for a volume flow control valve between the fuel pump and the high-pressure pump, said volume flow control valve being controlled by a control unit. The fuel through-flow through the volume flow control valve is adjusted depending on a current which flows in a valve coil of the volume flow control valve. The pressure in the fuel pressure accumulator can be adjusted via the fuel volume which is provided to the high-pressure pump.

The volume flow control valve normally has a leakage flow in the zero-flow state. This can result in an unwanted fuel pressure increase in the fuel pressure accumulator when the injection volumes are very small or, for example, no fuel is injected in the case of an overrun cut-off.

As a result of the construction, preventing the leakage flow in the zero-flow state of the volume flow control valve can only be achieved at considerable cost and is moreover undesirable in specific cases, if emergency operation of the internal combustion engine occurs in the event of a failure of the volume flow control valve or the control unit.

A regulator valve is normally provided at the fuel pressure accumulator, by means of which regulator valve the pressure in the fuel pressure accumulator can be adjusted depending on a control current. The regulator valve is actively controlled by the control current, such that the pressure in the fuel pressure accumulator is adjusted depending on the control current and depending on a fuel flow through the regulator valve. The fuel flow must exceed a threshold value so that the regulator valve can be operated in a linear range. This additional fuel flow through the regulator valve must be conveyed by the high-pressure pump, in order that the regulator valve can be operated in the linear range. When the high-pressure pump is dimensioned, it is therefore necessary to ensure that the high-pressure pump supplies the regulator valve with a minimum through-flow and moreover provides the volume that is required to build up the pressure or to maintain the fuel pressure in the fuel pressure accumulator.

SUMMARY OF THE INVENTION

The present invention addresses the problem of providing a method and a fuel system by means of which an internal combustion engine can be operated more efficiently and wherein, in particular, the fuel volume which the high-pressure pump must pump into the fuel pressure accumulator during regular operation is reduced.

This problem is solved by the method in accordance with the claims and the fuel system in accordance with the claims.

Further advantageous configurations of the invention are specified in the dependent claims.

In accordance with a first aspect of the present invention, a method for operating an internal combustion engine is provided. A fuel volume with a reference pressure is provided in a fuel pressure accumulator for injection into a combustion chamber. The pressure in the fuel pressure accumulator is generated via a high-pressure pump. The high-pressure pump is supplied with a fuel flow via a volume flow control valve. In a first operating mode, the pressure in the fuel pressure accumulator is set to the reference pressure by adjusting the fuel flow of the fuel that is supplied to the high-pressure pump depending on the fuel volume which must be injected and on the reference pressure. In a second operating mode, the pressure in the fuel pressure accumulator is set to the reference pressure by adjusting the pressure in the fuel pressure accumulator to the reference pressure by letting fuel escape from the high-pressure accumulator in the event of a predetermined fuel flow.

The reference pressure in the fuel pressure accumulator is normally adjusted by a volume flow control valve providing a fuel flow which is at least a certain amount more than the fuel volume which must be injected. This ensures that a regulator valve, via which fuel is carried away from the fuel pressure accumulator into the low-pressure circuit, can be operated in a linear range. The regulator valve is controlled by a control variable in such a way that a pressure is established in the fuel pressure accumulator when a specific through-flow occurs. The fuel is allowed to escape into the low-pressure circuit of the fuel system. Consequently, the high-pressure pump must pump more than a minimum volume of fuel into the fuel pressure accumulator, so that the pressure there can be adjusted to the reference pressure via the regulator valve. This requires a high-pressure pump which is dimensioned in such a way as to ensure an adequate delivery rate.

Furthermore, due to the technical construction of the volume flow control valve, it is not possible to completely shut off or adjust to an infinitely small value the fuel which is supplied to the high-pressure pump, because the volume flow control valve allows a continuous leakage flow to pass though. This is problematic in particular in the case of operating states in which there is little or no injection volume, e.g. in the event of an overrun cut-off, because the pressure in the fuel pressure accumulator rises continuously when the regulator valve is closed.

In order to avoid these disadvantages, provision is made for two operating states in accordance with the invention: In a first operating mode, the pressure in the fuel pressure accumulator is adjusted to the reference pressure. This is achieved by virtue of the reference pressure being controlled simply by providing the high-pressure pump with the fuel which must be injected though the injection valves. Because the supplied fuel volume is adjusted, the pressure in the fuel pressure accumulator can be regulated. In the meanwhile, the regulator valve is fully closed and a controlled release of fuel from the fuel pressure accumulator into the low-pressure circuit does not occur. In the first operating mode, therefore, the control of the fuel volume which must be injected and the reference pressure can be performed by merely regulating the fuel flow through the volume flow control valve.

A second operating mode relates to the operation of the internal combustion engine in the event of overrun cut-off, emergency operation, or in the case of very small injection volumes, e.g. when idling. In this case, the volume flow control valve is not activated and therefore the high-pressure pump merely transports the leakage flow through the volume flow control valve into the fuel pressure accumulator. If as a result of the leakage flow the supplied fuel volume is greater than the fuel volume which must be injected, the pressure in the fuel pressure accumulator rises above the reference pressure. The pressure in the fuel pressure accumulator is then achieved by allowing fuel to escape from the fuel pressure accumulator. Adjusting the pressure to the reference pressure using the regulator valve is also possible in the case of very small injection quantities if the regulator valve which allows the fuel to escape from the fuel pressure accumulator is not operated in a linear range. Using such a pressure adjustment, it is consequently not necessary to provide a minimum fuel flow via the high-pressure pump.

The second operating mode is adopted if the required fuel flow in the fuel pressure accumulator is less than the first fuel flow and/or the first operating mode is adopted if the required fuel flow exceeds a second fuel flow. The first fuel flow is preferably smaller than the second fuel flow in this case, so that a hysteresis thus formed can prevent a swinging between the first operating mode and the second operating mode when the fuel flow which must be injected is in a boundary range.

In accordance with a further aspect of the present invention, a fuel system for an internal combustion engine which has a fuel pressure accumulator is provided in order to provide a fuel volume which must be injected, said fuel volume having a reference pressure. The fuel system has a high-pressure pump in order to generate pressure in the fuel pressure accumulator. It also has a volume flow control valve in order to supply the high-pressure pump with an adjustable fuel flow. Fuel is carried away from the fuel pressure accumulator via a regulator valve. Provision is made for a control unit which is connected to the volume flow control valve in order to adjust the pressure in the fuel pressure accumulator in a first operating mode by means of the level of the fuel flow of the fuel which is delivered to the high-pressure pump depending on the fuel volume which must be injected and the reference pressure. The control unit is also connected to the regulator valve in order to close the regulator valve in a first operating mode and to adjust the pressure in the fuel pressure accumulator to the reference pressure by carrying the fuel away from the fuel pressure accumulator in a second operating mode.

In this way, it is possible to provide a fuel system which can be operated in two operating modes. The first operating mode relates to the operation of the internal combustion engine under load, wherein the reference pressure in the fuel pressure accumulator is adjusted via a control of the volume flow control valve. In the static state, the fuel flow through the volume flow control valve under constant load corresponds to the fuel volume which must be injected in each case, and therefore the pressure in the fuel pressure accumulator is maintained. In the second operating mode, the high-pressure pump is essentially supplied with the leakage flow through the volume flow control valve. In this case, the usual leakage flow is greater than the fuel volume which must be injected in the second operating mode. Using a pressure adjustment, the surplus fuel is now carried away from the fuel pressure accumulator via the regulator valve. In this case, the regulator valve is adjusted in such a way that the desired reference pressure is contingent in a defined manner, depending on the fuel flow of the fuel volume that is to be carried away and depending on a control current.

The regulator valve is preferably configured in such a way that in a second operating mode it carries the surplus fuel away from the fuel pressure accumulator into a fuel line which connects the volume flow control valve to a low-pressure pump. The control unit preferably has a switch unit in order to switch between the first operating mode and the second operating mode. The switch unit switches into the second operating mode when the fuel flow through the volume flow control valve falls below a first fuel flow and/or into the first operating mode when the fuel flow through the volume flow control valve exceeds a second fuel flow. The first fuel flow is preferably smaller then the second fuel flow in this case. In this way, it is possible to avoid swinging between the first and the second operating modes.

BRIEF DESCRIPTION OF THE DRAWINGS

Preferred embodiments of the invention are explained below with reference to the attached drawings, in which.

DETAILED DESCRIPTION OF THE INVENTION

Figure 1:
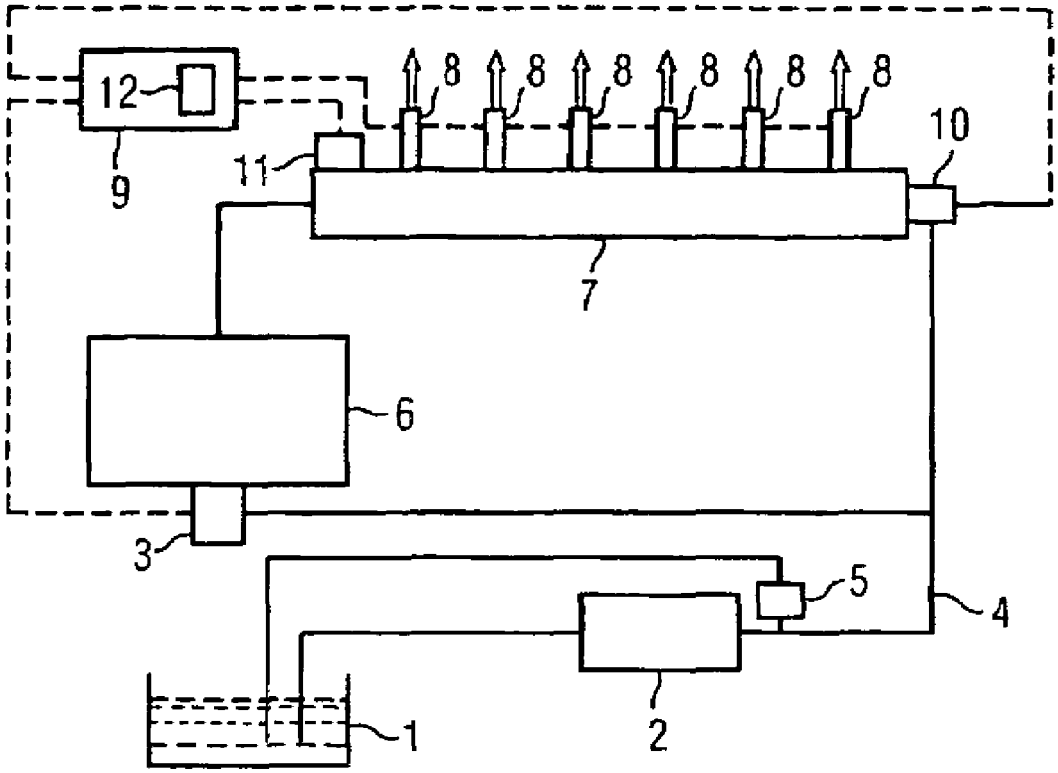
FIG. 1 shows a block schematic diagram of a fuel flow in accordance with the invention.

FIG. 1 illustrates a fuel injection system of an internal combustion engine, in particular a diesel engine. The fuel injection system has a fuel container 1 from which fuel is supplied to a volume flow control valve 3 via a low-pressure pump 2 and a supply line 4. In order to avoid damage to the supply line 4, provision is made for an overpressure valve 5 which carries fuel away into the fuel container 1 if there is an excessive fuel pressure in the supply line 4.

The volume flow control valve 3 is arranged directly at an inlet of a high-pressure pump 6, which carries the fuel that is provided at an output of the volume flow control valve 3 into a fuel pressure container 7 with an adjusted fuel flow. The high-pressure pump 6 is coupled to the internal combustion engine in such a way that the high-pressure pump 6 is driven by the internal combustion engine. The high-pressure pump 6 is capable of supplying the fuel to the fuel pressure accumulator 7 under a high discharge pressure.

The fuel pressure accumulator 7 is connected to injection valves 8 which inject fuel into combustion chambers of the internal combustion engine under the control of a control unit 9. The control unit 9 controls the time duration during which each individual injection valve 8 is open, and therefore the fuel which is under pressure in the fuel pressure accumulator 7 is injected into the combustion chambers.

The control unit 9 controls the volume flow control valve 3 and a regulator valve 10 using control signals. A reference pressure should prevail in the fuel pressure accumulator 7 in accordance with the rotational speed and load of the internal combustion engine which is to be driven, said reference pressure being checked by means of a pressure sensor 11 that is connected to the control unit 9. The pressure in the fuel pressure accumulator 7 is adjusted with the aid of the volume flow control valve 3 and the regulator valve 10. The fuel which is carried away via the regulator valve 10 is conveyed to the supply line 4 between the low-pressure pump 2 and the volume flow control valve 3.

In order to regulate the pressure in the fuel pressure accumulator 7, the volume flow control valve 3 delivers a fuel flow to the high-pressure pump 6 which fuel flow is greater than that injected through the injection valves 8 into the combustion chambers. In order to prevent the pressure in the fuel pressure accumulator 7 from rising above the reference pressure, the regulator valve 10 is opened by the control unit 9 using a control current, thereby carrying away the surplus transported fuel volume to the supply line 4 again.

In order to ensure that the pressure in the fuel pressure accumulator 7 can be adjusted as accurately as possible via the regulator valve 10, a minimum flow through the regulator valve is required.

Figure 3:
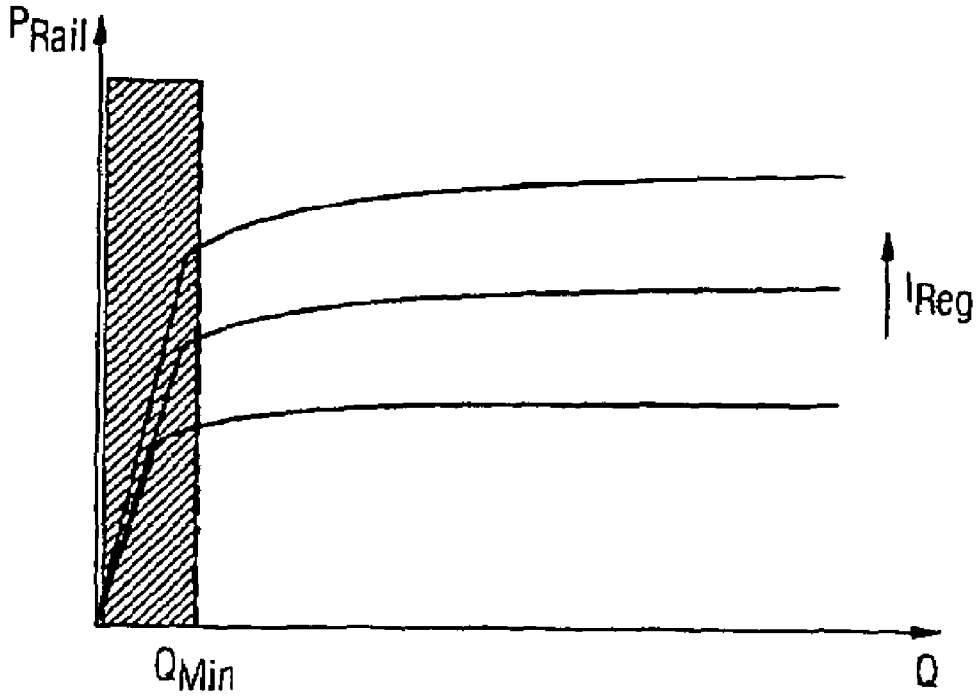
FIG. 3 shows a control diagram for the regulator valve for the pressure in the fuel pressure accumulator depending on the through-flow of the regulator and the control current which is applied to the regulator.

The characteristic curve for the regulator valve 10 is illustrated in FIG. 3. It is evident that only with a minimum fuel flow $Q_{min}$ through the regulator can the pressure $P_{rail}$ in the fuel pressure accumulator 7 be essentially adjusted by the control current from the control unit 9. If the fuel flow Q through the regulator valve 10 is less than the minimum fuel flow $Q_{min}$, the pressure $P_{rail}$ in the fuel pressure accumulator 7 depends more on the fuel flow Q through the regulator valve 10 and significantly less on the control current $I_{reg}$ which is provided by the control unit 9.

In order to ensure that the regulator valve 10 can be operated in the linear range, it is therefore normally necessary for the high-pressure pump 6 to supply the fuel pressure accumulator 7 with a fuel flow which exceeds, by at least the minimum fuel flow of the regulator valve 10, the fuel flow of the fuel volume that must be injected. This requires a corresponding dimensioning of the high-pressure pump 6, which must be capable of carrying the fuel volume which is predetermined thus.

The volume flow control valve 3 is activated by the control unit 9 via a control current, such that the flow of the fuel can be adjusted by the size of the control current. The volume flow control valve 3 normally has a leakage flow in the zero-flow state. This results in an unwanted fuel pressure increase in operating states having extremely small or zero injection volumes, e.g. in the case of emergency operation or in the case of overrun cut-off.

Figure 2:
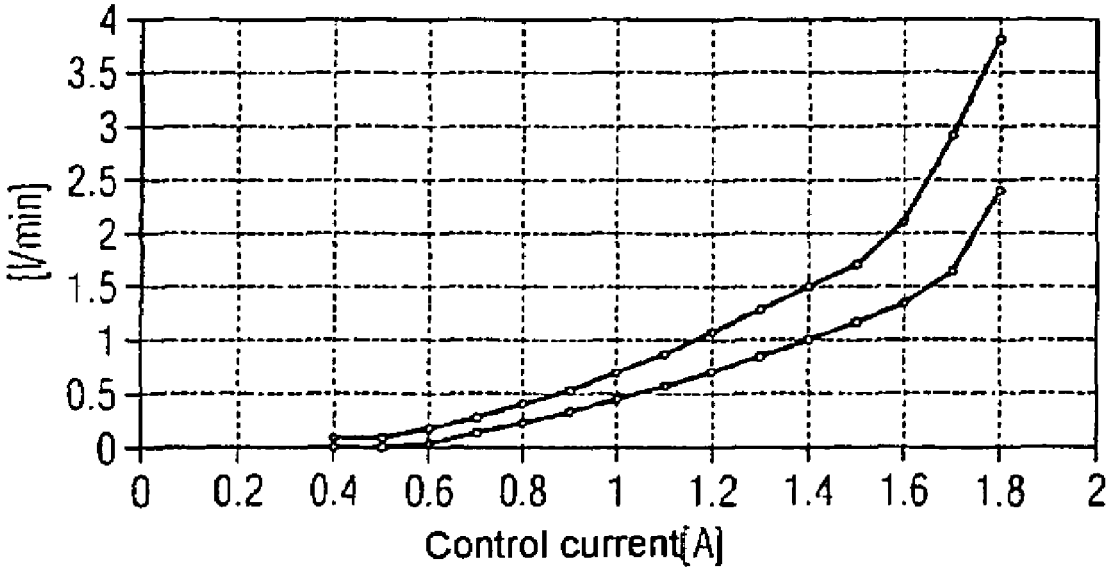
FIG. 2 shows a diagram for illustrating the dependency of the through-flow of the volume flow control valve on the applied control current and for illustrating component parameters.

FIG. 2 shows an upper and a lower limit of characteristic curves of volume flow control valves having an essentially identical construction. It can be seen that in the ranges between 0 and 0.6 A the volume flow control valve does not usually close completely and therefore a leakage flow reaches the fuel pressure accumulator 7 via the high-pressure pump 6. If less fuel is injected into the combustion chambers than is provided by this leakage flow, the pressure in the fuel pressure accumulator 7 increases. Since the minimum fuel flow for the regulator valve 10 is not given, the pressure which occurs in the fuel pressure accumulator 7 depends on the excessively supplied fuel volume and on the control current which has been set.

Figure 4:
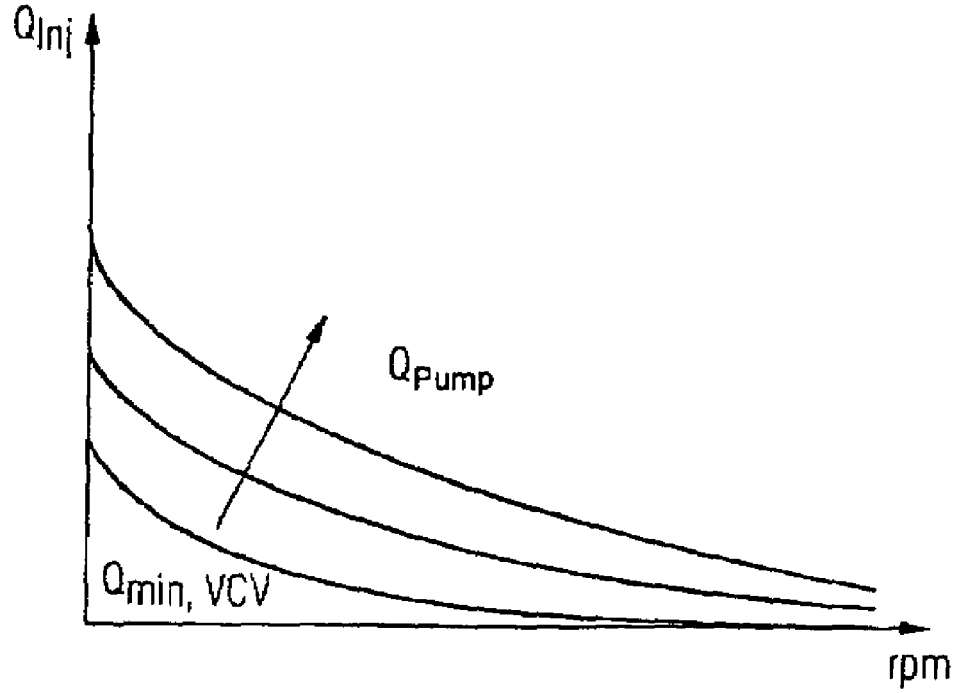
FIG. 4 shows a diagram for illustrating the dependency of the through-flow through the volume flow control valve depending on the engine speed and the fuel mass which is injected.

FIG. 4 illustrates the fuel flow through the volume flow control valve depending on the engine speed and the injected fuel volume $Q_{Inj}$.

For the operation of an internal combustion engine comprising such a fuel system, the invention now proposes that the control unit 9 should control the volume flow control valve 3 and the regulator valve 10 in accordance with two operating modes. The first operating mode is defined in that the fuel flow which can be transported through the volume flow control valve 3 via the high-pressure pump 6 into the fuel pressure accumulator 7 corresponds essentially to the fuel volume which must be injected. In this case the regulator valve 10 is not activated and therefore remains closed. The reference pressure in the fuel pressure accumulator 7 is therefore achieved by controlling the fuel flow through the volume flow control valve 3. During stable operation, therefore, the fuel flow which is supplied to the fuel pressure accumulator 7 will essentially correspond to the injected fuel volume.

The second operating mode is adopted if the minimum flow which flows through the volume flow control valve 3 as a result of leakage is greater than the fuel volume that must be injected. This occurs in particular in the case of an overrun cut-off, when no fuel is injected through the injection valves 8 into the combustion chambers. However, this can also occur in the case of emergency operation or when idling, depending on the size of the leakage flow of the volume flow control valve in the zero-flow state or in the slightly activated state respectively. In this event, the pressure in the fuel pressure accumulator 7 would rise continuously in the case of a closed regulator valve, and would therefore no longer be adjustable by the control unit 9 via the control variable for the volume flow control valve 3. For this reason, the second operating mode provides for adjusting the pressure in the fuel pressure accumulator 7 via the regulator valve 10. In this case, the regulator valve 10 is operated in the non-linear range. The control current which is provided by the control unit 9 is adapted to the linear profile of the characteristic curves of the regulator valve. In this way, the pressure in the fuel pressure accumulator 7 is essentially determined by the fuel volume which is excessively transported by the volume flow control valve 3 as a result of the leakage, and by the control current from the control unit 9.

The differentiation into two operating modes for the fuel system has the advantage on one hand that the high-pressure pump can have smaller dimensions since the regulator valve does not have to be supplied with the minimum fuel flow under normal operation, i.e. in the first operating mode. On the other hand the regulator valve can have a lower mechanical control quality, since this component is only operated as an auxiliary leakage. Furthermore, the driving torque can be significantly reduced, particularly in the range near to idling, since the pre-control of the regulator valve by means of the minimum fuel flow is not necessary.

The first operating mode is adopted when the required fuel flow, i.e. the fuel volume that must be injected, exceeds a first fuel flow and the second operating mode is adopted when the required fuel flow falls below a second fuel flow. The first fuel flow is greater than the second fuel flow in order to prevent any swinging changes between the first operating mode and the second operating mode in the boundary range.

Figure 5:
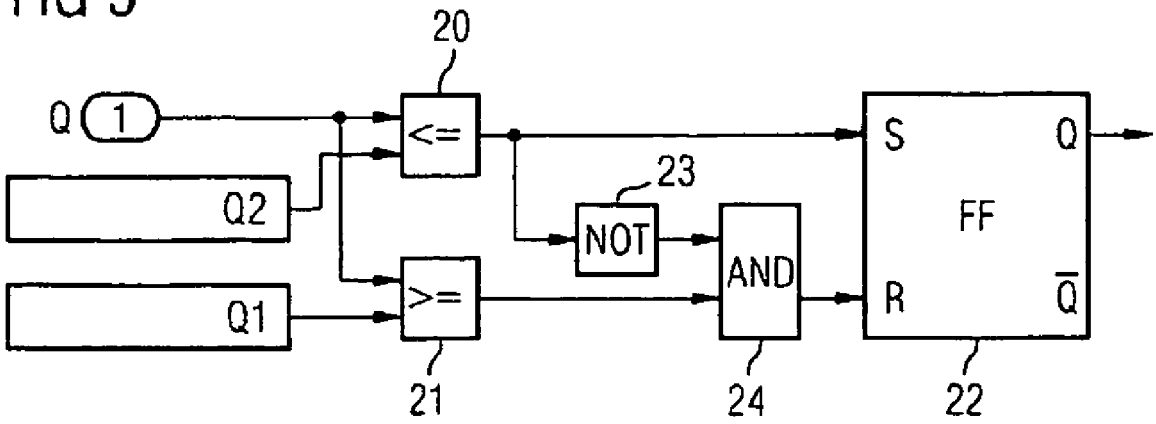
FIG. 5 shows a section of the control unit for switching between the first and the second operating modes.

FIG. 5 illustrates a possible switching unit 12, wherein said unit can be provided in the control unit 9 and serves to provide a hysteresis between the first and the second operating modes when switching. Values for a first fuel flow $Q_1$ and a second fuel flow $Q_2$ are supplied to the circuit. The fuel flow through the volume flow control valve 3 corresponds to the current fuel flow Q.

Provision is made for a first comparator unit 20 which compares the current fuel flow Q with the second fuel flow $Q_2$ and outputs a logical "1" as soon as the current fuel flow Q is smaller than the second fuel flow $Q_2$.

In a second comparator unit 21, the current fuel flow Q is compared with the first fuel flow $Q_1$ and a logical "1" is output when the current fuel flow Q exceeds the first fuel flow $Q_1$. The output of the first comparator unit 20 is connected to a set input of a flip-flop 22. Moreover, the output of the first comparator unit 20 is connected via an inverter 23 to an input of an AND logic element 24. An output of the second comparator unit 21 is connected to a further input of the AND logic element 24. An output of the AND logic element 24 is connected to a reset input of the flip-flop 22. In this way, the current operating mode can be sampled at the non-inverting output of the flip-flop 22. In this case, a logical "0" corresponds to the first operating mode and a logical "1" corresponds to the second operating mode.

In order to determine the threshold at which it is appropriate to switch into the first and second operating mode, it is necessary to determine the minimum fuel flow, i.e. the leakage flow through the volume flow control valve. The minimum fuel flow can be determined during overrun operation, i.e. when no injection into the combustion chambers takes place. For this, the pressure in the fuel pressure accumulator during overrun operation is briefly lowered and the reference pressure is then increased again, so that no fuel flow occurs through the regulator valve.

It is possible to calculate $Q_{min}$ from the increase of the pressure $P_{rail}(t)$ in the fuel pressure accumulator.

$$P_{rail}(t) = \frac{\beta}{V_{rail} * p} * m_{rail} + \frac{\beta}{V_{rail} * p} * \int_O^T (Q_{\min} - Q_{PCV} - Q_{inj})\,dt,$$

where β corresponds to the compressibility of the fuel, $m_{rail}$ to the mass of the fuel, $V_{rail}$ to the volume of the fuel pressure accumulator, ρ to the density of the fuel, $Q_{PCV}$ to the through-flow through the regulator valve, and $Q_{inj}$ to the through-flow through the injection valve.

The calculated minimum fuel flow $Q_{min}$ then corresponds to the leakage through the volume flow control valve. If the fuel pressure in the fuel pressure accumulator increases by Δp during the time T, then the following formula is produced for the overrun operation and for a closed regulator valve:

$$Q_{\min} = \frac{V_{rail} * p}{\beta} * \frac{\Delta p}{T}$$

The adaptation can takes place as follows, for example, assuming a reference pressure of 50 bar in the overrun operation:

The pressure in the fuel pressure accumulator was initially lowered to a first pressure of 40 bar, by virtue of the specification of the reference pressure of the pressure regulator being 40 bar. The reference pressure for the regulator valve is then specified at a second pressure of 120 bar and a time measuring device is started. The time T is measured until the pressure in the fuel pressure accumulator achieves a predefined third pressure, e.g. 60 bar (Δp=20 bar). It is then possible to calculate the minimum fuel flow $Q_{min}$ in accordance with the above-specified formula. As a further alternative, the minimum fuel flow can also be determined if the volume flow control valve is not activated during the time T, no through-flow occurs through the regulator valve, and the fuel volume $m_{inj}$ is injected.

$$Q_{\min} = \frac{V_{rail} * p}{\beta} * \frac{\Delta p}{T} + \frac{m_{inj}}{T}$$

The invention claimed is:

1. A method for operating an internal combustion engine, comprising:

providing a fuel pressure accumulator in order to provide a fuel volume which must be injected, the fuel volume having a reference pressure and a pressure in the fuel pressure accumulator is generated via a high-pressure pump and the high-pressure pump is supplied with an adjustable fuel flow;

adjusting from a control unit that is connected to a volume flow control valve upstream of the high-pressure pump the pressure in the fuel pressure accumulator in a first operating mode to the reference pressure by regulating the fuel flow of the fuel delivered to the high-pressure pump depending on the fuel volume which must be injected and the reference pressure; and separately adjusting from the control unit the pressure in the fuel pressure accumulator in a second operating mode to the reference pressure, adopted when the internal combustion engine is idling, by setting the pressure in the fuel pressure accumulator to the reference pressure by allowing fuel to escape from the fuel pressure accumulator in the event of a predetermined fuel flow.

2. The method as claimed in claim 1, wherein the second operating mode is adopted if the fuel flow is less than a first fuel flow and/or the first operating mode is adopted if the fuel flow exceeds a second fuel flow.

3. The method as claimed in claim 2, wherein the second operating mode is adopted in the case of overrun cut-off.

4. The method as claimed in claim 2, wherein the first fuel flow is smaller than the second fuel flow.

5. The method as claimed in claim 2, wherein the first and/or the second fuel flow is determined from a fuel leakage flow and the fuel leakage flow is determined in accordance with the steps, comprising:

setting an overrun operation of the internal combustion engine so that no fuel is injected;

setting the pressure in the fuel pressure accumulator to a first pressure value;

setting the reference pressure in order to increase the pressure in the fuel pressure accumulator in accordance with the first operating mode;

measuring the time for the pressure rise to the second pressure; and determining the fuel leakage flow using the time for the pressure rise and using the pressure difference between first pressure and second pressure.

6. The method as claimed in one of the claims 5, wherein in the first operating mode essentially no fuel is allowed to escape from the fuel pressure accumulator.

7. A fuel system for an internal combustion engine comprising:

a fuel pressure accumulator to provide a fuel volume that must be injected, the fuel volume having a reference pressure including a high-pressure pump to generate pressure in the fuel pressure accumulator;

a volume flow control valve to supply the high-pressure pump with an adjustable fuel flow;

a regulator valve to carry fuel away from the fuel pressure accumulator; and a control unit that is connected to the volume flow control valve to adjust the pressure in the fuel pressure accumulator in a first operating mode by the fuel flow of the fuel that is delivered to the high-pressure pump depending on the fuel volume that must be injected and the reference pressure, wherein the control unit is connected to the regulator valve in order to close the regulator valve in the first operating mode and to adjust the pressure in the fuel pressure accumulator to the reference pressure by carrying the fuel away from the fuel pressure accumulator in a second operating mode and wherein the control unit has a switch unit for switching between the first operating mode and the second operating mode, the switch unit switches into the second operating mode when the fuel flow through the volume flow control valve falls below a first fuel flow, and/or the switch unit switches into the first operating mode when the fuel flow through the volume flow control valve exceeds a second fuel flow.

8. The fuel system as claimed in claim 7, wherein in the second operating mode the regulator valve carries a surplus fuel away from the fuel pressure accumulator into a fuel line which connects the volume flow control valve to a low-pressure pump.

9. The fuel system as claimed in claim 7, wherein the regulator valve is arranged at an output of the high-pressure pump.

10. A method for operating an internal combustion engine, comprising:

providing a fuel pressure accumulator in order to provide a fuel volume which must be injected, the fuel volume having a reference pressure and a pressure in the fuel pressure accumulator is generated via a high-pressure pump and the high-pressure pump is supplied with an adjustable fuel flow;

adjusting the pressure in the fuel pressure accumulator in a first operating mode to the reference pressure by regulating the fuel flow of the fuel delivered to the high-pressure pump depending on the fuel volume which must be injected and the reference pressure; and adjusting the pressure in the fuel pressure accumulator in a second operating mode to the reference pressure by setting the pressure in the fuel pressure accumulator to the reference pressure by allowing fuel to escape from the fuel pressure accumulator in the event of a predetermined fuel flow, wherein the second operating mode is adopted if the fuel flow is less than a first fuel flow and/or the first operating mode is adopted if the fuel flow exceeds a second fuel flow and wherein the first and/or the second fuel flow is determined from a fuel leakage flow and the fuel leakage flow is determined in accordance with the steps, comprising:

setting an overrun operation of the internal combustion engine so that no fuel is injected;

setting the pressure in the fuel pressure accumulator to a first pressure value;

setting the reference pressure in order to increase the pressure in the fuel pressure accumulator in accordance with the first operating mode;

measuring the time for the pressure rise to the second pressure; and determining the fuel leakage flow using the time for the pressure rise and using the pressure difference between first pressure and second pressure.

11. The method as claimed in claim 10, wherein the second operating mode is adopted when the internal combustion engine is idling and/or in the case of overrun cut-off.

12. The method as claimed in claim 10, wherein the first fuel flow is smaller than the second fuel flow.

13. The method as claimed in one of the claims 10, wherein in the first operating mode essentially no fuel is allowed to escape from the fuel pressure accumulator.

* * * * *